US005737810A

United States Patent [19]

Krauss

[11] Patent Number: 5,737,810

[45] Date of Patent: Apr. 14, 1998

[54] SIDE RELEASE BUCKLE WITH INCREASED HOLDING STRENGTH

[75] Inventor: Mark J. Krauss, E. Greenwich, R.I.

[73] Assignee: American Cord & Webbing Co, Inc., Woonsocket, R.I.

[21] Appl. No.: 727,252

[22] Filed: Oct. 8, 1996

Related U.S. Application Data

[63] Continuation-in-part of Ser. No. 284,182, Aug. 2, 1994, Pat. No. 5,590,444.

[51] Int. Cl.[6] ..... A44B 11/26

[52] U.S. Cl. ..... 24/625

[58] Field of Search ..... 24/625, 614–616

[56] References Cited

U.S. PATENT DOCUMENTS 4,694,544 9/1987 Chapman ..... 24/625

4,712,280 12/1987 Fildan ..... 24/625

5,131,122 7/1992 Lavato ..... 24/625

*Primary Examiner*—James R. Brittain

*Attorney, Agent, or Firm*—Kane, Dalsimer, Sullivan, Kurucz, Levy, Eisele and Richard, LLP

[57] ABSTRACT

A side release buckle has a female member and a male member which includes a central post that is received in a channel of the female member and a pair of spaced somewhat parallel flexible engagement or latching arms having protuberances or heads that have crescent shaped latching shoulders. The arms flex inwardly as they enter an opening into a cavity of the female member and then outwardly when the heads are aligned with the side aperture at which the crescent shaped shoulders engage surfaces of the side walls of the female member adjacent these apertures. The crescent shaped shoulders supply increased bearing area capable of resisting more efficiently the linear and torsional loads normally encountered by side released buckles.

9 Claims, 1 Drawing Sheet

SIDE RELEASE BUCKLE WITH INCREASED HOLDING STRENGTH

CROSS REFERENCE TO RELATED APPLICATION

This application is a continuation in part of U.S. application Ser. No. 08/284,182 filed Aug. 2, 1994, now U.S. Pat. No. 5,590,444.

BACKGROUND OF THE INVENTION

1. Field of the Invention

This invention relates generally to buckles, and more particularly to a side release buckle having improved holding strength.

2. Description of the Related Art

It is well known in the prior art to provide a plastic buckle having a female member and a male member that are latched by flexible engagement or latching arms and released by engaging the sides of the arms and pressing them inwardly. Such buckles are used in toolbelts, life preservers, harnesses, seatbelts, scuba equipment employing straps, belts or webs to be interconnected. An example of such a buckle is disclosed in U.S. Pat. No 5,222,279 and commonly assigned U.S. patent application Ser. No. 08/284,182 filed Aug. 2, 1994, now U.S. Pat. No. 5,590,444, entitled Side Release Buckle With Improved Distribution of Stress Under Loads.

Under normal conditions, side release buckles of the prior are may experience stress from straight or torsional loads caused by movement of the interconnection or latched webs. The straight load is responsive to a linear force and a torsional load is responsive to a twisting force applied or transmitted to the webs. When these forces interact, the male member may, at times, disengage or release from the female member because the flexible arms unlatch or even break when the stresses reach certain high level. The buckle of the above referenced application addresses the problem.

Nevertheless, it would be desirable to improve further upon the buckle of the above referenced patent and patent application by creating more resistive forces and distributing the stress forces better.

SUMMARY OF THE INVENTION

The principal object of this invention is to provide an improved latching engagement between surfaces of the flexible arms of a male member and surfaces of the female member of a side release buckle thereby providing optimum resistance to straight and torsional loads.

The foregoing object is achieved in accordance with the present invention by an improved side release buckle having a male member and female member. The female member includes opposed side walls, a top and bottom wall, a channel disposed therebetween and an opening exposing a cavity with the channel and for receiving the male member. The female member further including a recess in each side wall and a side aperture in the recess of each side wall.

The male member includes a central post that is received in the channel of the female member and a pair of spaced somewhat parallel flexible engagement or latching arms having protuberances or heads that have crescent shaped latching shoulders. The arms flex inwardly as they enter the opening into the cavity of the female member and then outwardly when the heads are aligned with the side aperture at which the crescent shaped shoulders engage surfaces of the side walls of the female member adjacent these apertures. The crescent shaped shoulders supply increased bearing area capable of resisting more efficiently the linear and torsional loads normally encountered by side released buckles.

Other objects and advantages will become apparent from the following detailed description which is to be taken in conjunction with accompanying drawings.

DETAILED DESCRIPTION

Figure 1:
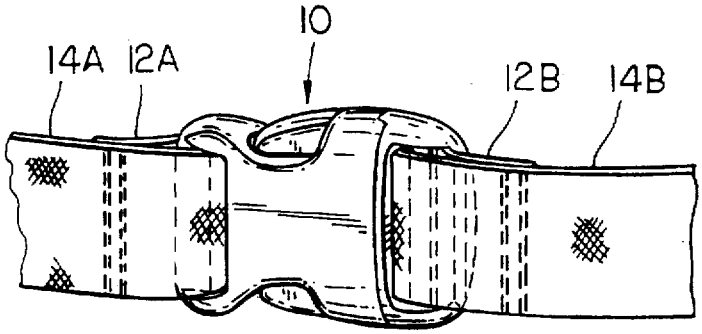
FIG. 1 is a perspective view of the side release buckle of the present invention in a latched condition and coupled with web ends.

A side release buckle 10 is utilized to releasably connect or couple free ends 12A, 12B of webs, belts or straps 14A, 14B. Buckle 10 includes a female member 16 and male member 18 which are preferably made and molded of plastic. The straps 14A,14B, are preferably connected by threading the free ends 12A,12B through and around a rear portion of the female member 16 and male member 18, respectively, and then sewing, riveting or connecting in any well known manner the free ends 12A, 12B back onto the respective straps 14A, 14B.

The female member 16 is formed with a top wall 20, bottom wall 22, and opposed sidewalls 24 and 26. The forward portion of the female member 16 includes an opening 28 leading to a cavity 30. A channel 32 defined by transversely extending parallel ribs 34A,34B serves to rigidify the female member but more importantly guide and center the male member as will be evident shortly. The sidewalls 24,26 are formed with recesses 36,38 in which apertures 40,42, respectively, communicate with cavity 30.

Figure 2:
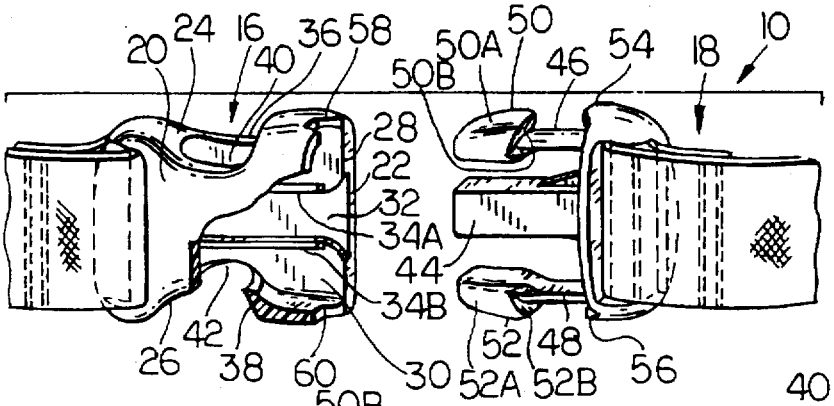
FIG. 2 is a similar perspective view of the buckle in an unlatched condition and with certain parts of the female member broken away and removed.
Figure 3:
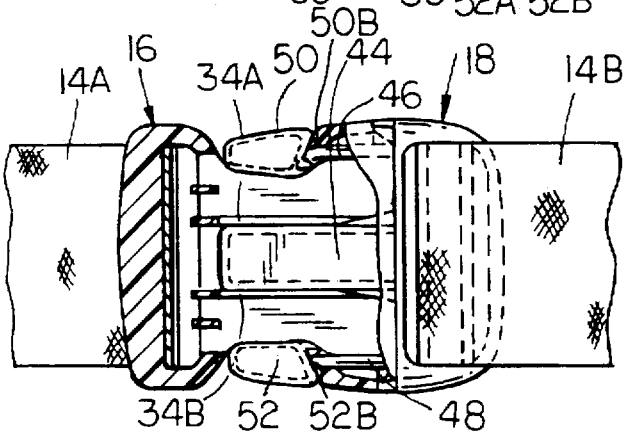
FIG. 3 is a top plan view of the buckle in a latched condition with certain parts of the female member broken away and removed.
Figure 4:
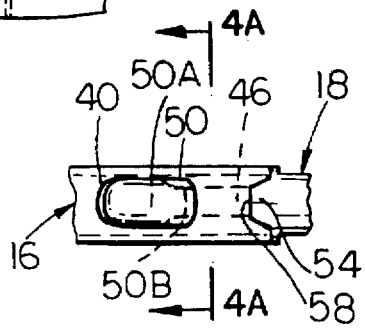
FIG. 4 is an enlarged fragmentary side view taken along the line 4—4 of FIG. 3.
Figure 4A:
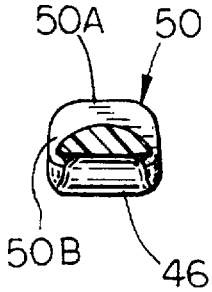
FIG. 4A is an enlarged fragmentary side view taken along the line 4A—4A of FIG. 4.

Referring to the male member 18 and as will be explained in detail, the cavity 30 of female member 16 receives and surfaces thereof cooperate in releasably latch male member 18. In this regard, male member 18 includes a central forwardly extending post 44 that is advantageously received by channel 32. The interengagement and cooperation of the surfaces defining channel 32 including sides 34A,34B and post 44 center the male member 18 upon and during insertion into the female member 16 but also cooperate in resisting torsional loads as well. A pair of spaced flexible arms 46,48 also extend forwardly and each are provided with enlargements or heads 50,52, respectively. Each head includes a rounded cam face 50A,52A which engage side surfaces of opening 28 upon introduction of male member 18 into female member 16 to pivot arms 46,48 inwardly towards one another. When heads 50,52 are opposite to the respective apertures 40,42, the arms pivot outwardly so that the heads extend out of the aperture as shown more closely in FIG. 3. Each head also includes a crescent shaped or semi-circular shoulder 50B,52B which engage with neighboring surfaces of the side wall recesses 36,38 adjacent aperture 40,42 respectively, as shown in FIG. 4. This crescent shaped engagement is an important and unique contribution to the buckle art and provides for increased bearing area, heretofore unrealized in the buckle art, and, consequently, increased resistance to linear pulling loads and to some extent torsional loads thereby lessening the potential failure or premature releasing of the buckle at this location. This superior interengagement is enhanced by the formation of the shoulders 50B, and 52B at an angle as shown clearly in FIGS. 2 and 3. Thus, if a linear pulling load is applied to buckle 10 that would tend to pull male member 18 and female member 16 apart, this inclination will force the heads 50,52 further outwardly thereby providing increased holding power further preventing premature release.

Torsional loads are further resisted by the interengagement of lugs 54,56 at the base or rear end of male member 18 and accommodated mating recesses 58,60 at the forward end of side walls 24,26.

To releasably latch the male member 18 to the female member 16, the heads 50,52 of arms 46,48 together with the leading end of post 44 are inserted through opening 28 into cavity 30. The engagement of curved faces 50A,52A with surfaces of the sides 24,26 at the opening 28 wall cam or force the arms 46,48 inwardly towards one another while post 44 rides in the channel 32. Arms 46,48 and post 44 will continue to move within cavity 30, upon further insertion of the male member 18 into female member 16. Eventually the heads 50,52 will align with apertures 40,42 at which point the arms will pivot or snap outwardly into the apertures 40,42. When this occurs, shoulders 50B,52B will engage with adjacent surfaces of the side wall recesses 36,38 at the apertures 40,42. This latched position is shown more clearly in FIG. 3.

Figure 5:
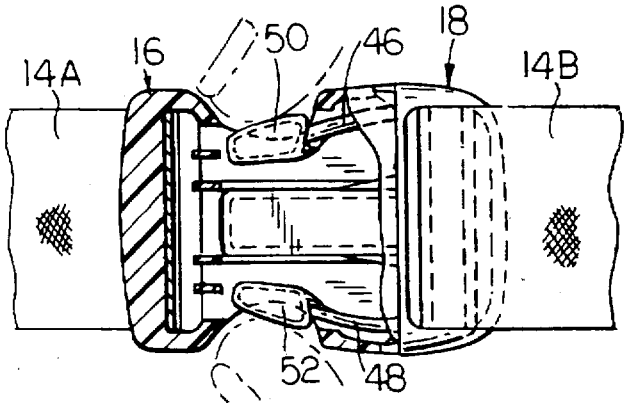
FIG. 5 is a top plan view similar to FIG. 3 showing the buckle in the process of being unlatched.

As shown in FIG. 5, to unlatch or release the buckle to separate the male member 18 from the female member 16, the heads 50,52 are digitally engaged and pivoted or moved inwardly towards one another to clear the shoulders 50B, 52B from the side walls 24,26. When this occurs the male member 18 and female member 16 are pulled apart to remove arms 46,48 and post 44 from cavity 30.

Thus, the several aforementioned objects and advantages are most effectively attained. Although a single somewhat preferred embodiment of the present invention has been disclosed and described in detail herein, its scope is to be determined by that of the appended claims.

What is claimed is:

1. A side release buckle having increased resistance to linear pulling loads and torsional loads, comprising:

a female member having a forward end and a rear end and a top wall, bottom wall and sidewalls defining a cavity and an opening into the cavity at the forward end, the sidewalls each having a recess and an aperture in the recess communicating with the cavity, a male member having a forward end a rear end and at least one flexible arm having a forward end extending forwardly from the male member rear end for insertion through the opening into the cavity of the female member, a head at the forward end of the arm and adapted to be pivoted outwardly through the aperture when the head is aligned with the aperture, the head having a crescent shaped shoulder for engaging with surfaces of the sidewall recess adjacent the aperture to provide crescent shaped engagement means between the shoulder and the surfaces for increased bearing area to resist pulling loads and to some extent torsional loads thereby lessening the potential failure and premature releasing of the buckle.

2. The invention in accordance with claim 1 wherein a pair of spaced flexible arms with heads extend forwardly from the rear end of the male member.

3. The invention in accordance with claim 2 wherein the female member has internal walls in the cavity cooperating in defining a channel, and the male member has a forwardly extending post interposed between the arms for insertion into the channel and cooperating therewith in resisting torsional loads.

4. The invention in accordance with claim 1 wherein the shoulder is at an angle and is so constructed and arranged such that pulling loads on the male and female member forces the head further outwardly through the aperture.

5. The invention in accordance with claim 1 wherein means are provided for resisting torsional loads.

6. The invention in accordance with claim 5 wherein the means includes at least one mating lug and accommodating recess on the male member and female member.

7. The invention in accordance with claim 6 wherein a mating lug and accommodating recess are respectively at the rear end of the male member and forward end of each side member.

8. The invention in accordance with claim 1 wherein means are provided on the male member and female member for coupling with the end of a web.

9. The invention in accordance with claim 1 wherein a pair of spaced flexible arms with heads extend forwardly from the rear end of the male member, the female member has internal walls in the cavity cooperating in defining a channel, and the male member has a forwardly extending post interposed between the arms for insertion into the channel and cooperating therewith in resisting torsional loads, the shoulder is at an angle and is so constructed and arranged such that pulling loads on the male and female member forces the head further outwardly through the aperture, means are provided for resisting torsional loads, the means including at least one mating lug and accommodating recess on the male member and female member, a mating lug and accommodating recess being at the rear end of the male member forward end of each side member, and means are provided on the male member and female member for coupling with the end of a web.

* * * * *